US006217729B1

(12) United States Patent
Zolotarsky et al.

(10) Patent No.: US 6,217,729 B1
(45) Date of Patent: Apr. 17, 2001

(54) ANODE FORMULATION AND METHODS OF MANUFACTURE

(75) Inventors: Vadim Zolotarsky, Springfield; David B. Blum, Wayne; Mark J. Geusic, Basking Ridge; Irina Ivanter, Sayerville, all of NJ (US)

(73) Assignee: United States Filter Corporation, Palm Desert, CA (US)

( * ) Notice: Subject to any disclaimer, the term of this patent is extended or adjusted under 35 U.S.C. 154(b) by 0 days.

(21) Appl. No.: 09/288,494

(22) Filed: Apr. 8, 1999

(51) Int. Cl.[7] ..... C25B 11/08

(52) U.S. Cl. ..... 204/290.08; 204/290.03; 204/290.06; 204/290.09; 204/290.12; 204/290.13; 204/290.14

(58) Field of Search ..... 204/290.03, 290.06, 204/290.08, 290.12, 290.13, 290.14, 290.09

(56) References Cited

U.S. PATENT DOCUMENTS

| | | | | |
|---|---|---|---|---|
| 4,395,436 | * | 7/1983 | Bianchi et al. | 204/290 F |
| 4,399,199 | | 8/1983 | McGill et al. | 428/633 |
| 4,585,540 | | 4/1986 | Beer et al. | 204/290 |
| 4,797,182 | | 1/1989 | Beer et al. | 204/14.1 |
| 5,128,000 | | 7/1992 | Klotz et al. | 204/89 |
| 5,290,415 | | 3/1994 | Shimamune et al. | 204/290 |
| 5,314,601 | | 5/1994 | Hardee et al. | 204/290 |
| 5,531,875 | * | 7/1996 | Shimamune et al. | 204/290 F |
| 5,593,556 | * | 1/1997 | Kumagai et al. | 204/290 F |

FOREIGN PATENT DOCUMENTS

| | | |
|---|---|---|
| 0 243 302 | 10/1987 | (EP) . |
| 0 344 378 | 12/1989 | (EP) . |
| 0 699 780 | 3/1996 | (EP) . |

OTHER PUBLICATIONS

International Search Report PCT/US00/09435, dated Aug. 1, 2000.

* cited by examiner

*Primary Examiner*—Bruce F. Bell
(74) *Attorney, Agent, or Firm*—Wolf, Greenfield & Sacks, P.C.

(57) ABSTRACT

The present invention provides an improved anode formulation and an improved method of manufacture. More specifically, the invention provides a tri-layer anode having an improved service life when used, for example, for steel strip electrogalvinizing. In one embodiment of the invention, the anode is comprised of a titanium substrate which is roughened and heat treated and subsequently coated with a first coating of iridium oxide/tantalum oxide. After the anode is heat treated, it is next coated, preferably by an electrodeposition process with a second coating of platinum. Finally, the anode is coated with a third coating of iridium oxide/tantalum oxide and subsequently heat treated.

26 Claims, No Drawings

ANODE FORMULATION AND METHODS OF MANUFACTURE

BACKGROUND OF THE INVENTION

Anodes have been used commercially for many years in electrolytic processes for the preparation of various chemicals such as chlorine, bromine and hydrogen peroxide, for the electrodeposition of metals such as chromium, copper and zinc, as well as for high speed electroplating such as electrogalvanizing.

The conventional electrolytic anode consists of a substrate made of a valve metal, such as titanium, niobium, tantalum or zirconium or an alloy of these metals, and an electrocatalytic coating of a precision metal(s) or precious metal oxide(s), where the precious metal is usually a platinum group metal, such as iridium, platinum, rhodium or ruthenium. The precious metal or metal oxide coating is often mixed with the oxides of the valve metals. Typically, the valve metal substrate is also subjected to a surface treatment such as chemical etching, mechanical gritblasting and/or the application of a wash coat, prior to the electrocatalytic coating. The electrocatalytic coating is also typically applied by either electrodeposition or thermal deposition methods. Also, with the development of new high speed electrogalvanizing processes, where extremely low pH, high current densities and elevated temperatures are employed, a barrier layer has been introduced to protect the valve metal substrate from its passivation.

For example, U.S. Pat. No. 4,203,810 to Warne discloses an anode for use in an electrolytic process comprising a substrate of titanium, tantalum, or niobium over which a barrier layer containing platinum or platinum-iridium alloy is formed by painting a chemical compound containing platinum and iridium over the substrate, the painted substrate subsequently being heat treated. A layer of a precious metal is applied over the anode by an electroplating process.

Similarly, U.S. Pat. No. 4,331,528 to Beer discloses an anode having a film forming substrate of titanium, tantalum, zirconium, etc. over which a thin barrier layer is formed. The barrier constitutes a surface oxide film grown up from substrate that also incorporates rhodium or iridium metal or their compounds in an amount of less than 1 g/m$^2$ (as metal). The anode is then thermally coated with an electrocatalytic coating comprising at least one platinum-group metal or metal oxide possibly mixed with other metal oxides, in an amount of at least about 2 g/m$^2$.

Additionally, U.S. Pat. No. 4,528,084 to Beer discloses an anode having a barrier layer formed over a substrate from a solution containing a thermo-decomposable compound of a platinum-group metal and also a halide which attacks the substrate which purportedly results in increased performance.

U.S. Pat. No. 4,913,973 to Geusic discloses an anode comprised of a valve metal substrate over which a barrier layer consisting of at least 150 $\mu$inches of electroplated platinum is formed. The barrier layer is subsequently heated at high temperatures to reduce the porosity of the barrier layer. A second thermally deposited coating of iridium oxide is subsequently deposited over the barrier layer.

U.S. Pat. No. 5,672,394 to Hardee describes an anode with a surface roughness of at least 250 microinches (6 microns) and an average surface peaks per inch of at least 40 that has a ceramic barrier layer followed by a thermally deposited electrocatalytic coating composed of a mixture of iridium and tantalum oxides.

SUMMARY OF THE INVENTION

The present invention provides an anode having an improved service life when used in electrolytic processes characterized by, for example, low pH and/or high temperature and or high current density. The anode of the present invention comprises: (a) a valve metal substrate; (b) a first layer comprising at least one platinum-group metal or platinum-group metal oxide and at least one valve metal or valve metal oxide formed on the valve metal substrate; (c) a second layer comprising a platinum-group metal formed on the first layer; and (d) a third layer comprising at least one platinum-group metal or platinum-group metal oxide and at least one valve metal or valve metal oxide formed on the second layer.

The present invention also provides a method for preparing a anode comprising the steps of: (a) forming a first layer comprising at least one platinum-group metal or platinum-group metal oxide and at least one valve metal or valve metal oxide on a valve metal substrate; (b) forming a second layer of a platinum-group metal on the first layer; and (c) forming a third layer comprising at least one platinum-group metal or platinum-group metal oxide and at least one valve metal or valve metal oxide on the second layer.

DETAILED DESCRIPTION OF THE INVENTION

In the anode of the present invention, the valve metal substrate may include at least one valve metal such as titanium, niobium, tantalum, or zirconium. Preferably, the valve metal substrate is made of titanium. Prior to the formation of the first layer onto the substrate, the surface of the substrate may be cleaned using conventional procedures including but not limited to vapor degreasing, alkaline cleaning, and the like. Preferably, the surface is cleaned using a commercial alkaline cleaning bath for 20–30 minutes at 50–60° C. After the surface is cleaned, the surface is preferably roughened using conventional mechanical or chemical means, such as, for example, by grit blasting or acid etching. Preferably, the surface is roughed using an aluminum oxide grit. It is preferred that the surface have a roughness Rq of 2–12 $\mu$m, and more preferably an Rq of 3–6 $\mu$m, and most preferably an Rq of 4–5 $\mu$m as measured using the SURFTEST 212 surface roughness tester (Mitutoyo, Japan). After the surface of the substrate is roughed, it may be further subjected to thermal oxidation by heating the surface at an elevated temperature in an oxygen containing atmosphere for 1–3 hours. The temperature of such treatment is preferably 350–600° C., and more preferably 400–500° C.

The first layer to be formed on the substrate includes at least one platinum-group metal or platinum-group metal oxide and at least one valve metal or valve metal oxide. Suitable platinum-group metals and oxides thereof include ruthenium, osmium, rhodium, iridium, palladium, platinum, ruthenium oxide, osmium oxide, rhodium oxide, iridium oxide, palladium oxide, and platinum oxide. Suitable valve metals and valve metal oxides include but are not limited to tantalum, tantalum oxide, titanium, titanium oxide, zirconium, and zirconium oxide. In the preferred embodiment of the invention, the first layer includes iridium oxide and tantalum oxide.

The first layer is formed on the substrate using conventional procedures such as applying one or more coatings of a solution containing the selected metal salts or other compounds onto the substrate until the total loading of the first layer, after suitable thermal treatment, is 0.5–2.5 g/m$^2$, and more preferably 1.8–2.2 g/m$^2$. The coating may be prepared by combining the selected metal salts or other compounds with an aqueous or alcohol solution. In the preferred embodiment, the substrate is painted with a n-butanol solution containing salts of iridium and tantalum. The ratio of iridium to tantalum in the solution is also preferably about 65% to 35% by weight. After each coating is applied, it is desirable to let the coating air dry which typically takes approximately 20 minutes. After each coating is air dried, the coating is heated in an oxygen containing atmosphere to permit the components to decompose into their respective stable metal or oxide form. The duration of heat treatment will depend upon the temperature of the heat treatment. The inventors have found that a heat treatment at a temperature of approximately 500° C. for approximately 20–30 minutes is sufficient to form an iridium oxide/tantalum oxide composite coating. However, the actual temperature and duration of treatment may be different if other metals are used and can be determined by the skilled artisan. The process of painting and heat treating the titanium substrate is repeated as necessary in order to obtain a first layer having the desired total loading. After the desired loading is achieved, the first layer may then be subjected to a final heat treatment at about 500° C. for about one hour.

The second layer to be formed on the first layer is made of a platinum-group metal (i.e., ruthenium, osmium, rhodium, iridium, palladium, and platinum). Preferably, the second layer is platinum. The second layer is formed on the first layer using conventional procedures known in the art such as electrodeposition, sputtering, or chemical vapor deposition of the platinum-group metal onto said first layer. In the preferred embodiment, the second layer is formed by electrodeposition from a solution containing platinum salt. The thickness of the second layer is 0.1–3.0 $\mu$m, and preferably 0.25–1.0 $\mu$m.

The third layer to be formed on the second layer includes at least one platinum-group metal or platinum-group metal oxide and at least one valve metal or valve metal oxide. Suitable platinum-group metals and oxides thereof include ruthenium, osmium, rhodium, iridium, palladium, platinum, ruthenium oxide, osmium oxide, rhodium oxide, iridium oxide, palladium oxide, and platinum oxide. Suitable valve metals and value metal oxides include tantalum, tantalum oxide, titanium, titanium oxide, zirconium, and zirconium oxide. In the preferred embodiment of the invention, the third layer includes iridium oxide and tantalum oxide.

The third layer is formed on the second layer using conventional procedures such as applying one or more coatings of a solution containing the selected metals onto the substrate until the total loading of the third layer, after suitable thermal treatment, is 5–100 g/m$^2$, and more preferably 10–40 g/m$^2$. For industrial use, the loading is more preferably 15–40 g/m$^2$, and most preferably 20–35 g/m$^2$. The coating may be prepared by combining the selected metal salts or other compounds with an aqueous or alcohol solution. In the preferred embodiment, the second layer is painted with a n-butanol solution containing salts of iridium and tantalum. The ratio of iridium to tantalum in the solution is also preferably about 65% to 35% by weight. After each coating is applied, it is desirable to let the coating air dry which typically takes approximately 20 minutes. After the coating is air dried, the coating is heated in an oxygen containing atmosphere to permit the components to decompose into their respective stable metal or oxide form. The duration of heat treatment will depend upon the temperature of the heat treatment. The inventors have found that a heat treatment at a temperature of approximately 500° C. for approximately 20–30 minutes is sufficient to form an iridium oxide/tantalum oxide composite coating. However, the actual temperature and duration of treatment may be different if other metals are used and can be determined by the skilled artisan. The process of painting and heat treating is then repeated as necessary in order to obtain a third layer having the desired total loading. After the desired loading is achieved, the third layer may then be subjected to a final heat treatment at about 500° C. for about one hour.

The present invention is described in the following examples which are set forth to aid in the understanding of the invention, and should not be construed to limit in any way the invention as defined in the claims which follow.

Anodes Prepared In Accordance With The Present Invention

EXAMPLES 1A AND 1B

A titanium substrate was cleaned with an alkaline cleansing bath and then roughened by grit blasting with grit 60 aluminum oxide. The surface roughness of the roughened area of the substrate was in the Rq range of 4 $\mu$m to 6 $\mu$m as measured with a SURFTEST 212 surface roughness tester.

After the titanium substrate surface was roughened, it was painted with a n-butanol solution containing salts of iridium and tantalum in a ratio of iridium to tantalum of approximately 65% to 35% by weight. The applied solution was allowed to dry at ambient temperature for approximately 20 minutes. The painted titanium substrate was subsequently heat treated in a furnace having an oxygen containing atmosphere at approximately 500° C. for approximately 20–30 minutes to form an iridium oxide/tantalum oxide composite coating. The process of painting and heat treating the titanium substrate was repeated in order to obtain a total loading of about 2.0 g/m$^2$. After this loading was achieved, the painted substrate was heat treated for approximately one hour at approximately 500° C.

A second layer of platinum was formed over the first layer by electrodeposition from a solution containing platinum salt. The thickness of the platinum second layer was in one example (i.e., Example 1A) 10 $\mu$inches. In a second example (i.e., Example 1B) the thickness of the platinum second layer was 20 $\mu$inches.

Following the electrodeposition process, the anode was again painted with an n-butanol solution containing salts of iridium and tantalum. The ratio of iridium to tantalum in the solution being approximately 65% to 35% by weight. The solution was allowed to dry at ambient temperature for approximately 20 minutes, and the anode was subsequently heat treated in a furnace having an oxygen containing atmosphere at approximately 500° C. for approximately 20–30 minutes to form an iridium oxide/tantalum oxide composite coating. The process of painting and heat treating was repeated to obtain a third layer having a total loading of 10 g/m$^2$. The anode was then heat treated for approximately one hour at approximately 500° C.

EXAMPLES 2A–2C

A titanium substrate was cleaned with an alkaline cleansing bath and then roughened by grit blasting with grit 30 aluminum oxide. The surface roughness of the substrate being in an Rq range from 6 $\mu$m to 8 $\mu$m as measured with a SURFTEST 212 surface roughness tester. After the substrate surface was roughened, the substrate was heat treated at approximately 450° C. in an oxygen containing atmosphere for approximately two hours in order to form an oxide layer over the substrate surface.

After the roughened titanium substrate surface was heat treated, it was painted with a n-butanol solution containing salts of iridium and tantalum. The ratio of iridium to tantalum in the solution was about 65% to 35% by weight. The solution was allowed to dry at ambient temperature for approximately 20 minutes. The painted titanium substrate was subsequently heat treated in a furnace having an oxygen containing atmosphere at approximately 500° C. for approximately 20–30 minutes to form an iridium oxide/tantalum oxide composite coating. The process of painting and heat treating the titanium substrate was repeated to obtain a first layer having a total loading of 2.0 g/m$^2$. After the desired loading was achieved, the anode was heat treated for approximately one hour at approximately 500° C.

A second layer of platinum was formed over the first layer by electrodeposition from a solution containing platinum salt. The thickness of the platinum second layer was in one example (i.e., Example 2A) 10 $\mu$inches. In a second example (i.e., Example 2B) the thickness of the platinum second layer was 20 $\mu$inches, and in a third example (i.e., Example 2C), the thickness of the platinum third layer was 30 $\mu$inches.

Following the electrodeposition process, the anode was again painted with an n-butanol solution containing salts of iridium and tantalum. The ratio of iridium to tantalum in the solution being approximately 65% to 35% by weight. The solution was allowed to dry at ambient temperature for approximately 20 minutes, and the anode was subsequently heat treated in a furnace having an oxygen containing atmosphere at approximately 500° C. for approximately 20–30 minutes to form an iridium oxide/tantalum oxide composite coating. The process of painting and heat treating was repeated to obtain a third layer having a total loading of 10 g/m$^2$. When the desired loading was achieved, the anode was heat treated for approximately one hour at approximately 500° C.

EXAMPLES 3A AND 3B

A titanium substrate was cleaned with an alkaline cleansing bath and then roughened by grit blasting with grit 60 aluminum oxide. The surface roughness of the roughened substrate being in an Rq range of 4–6 $\mu$m as measured with a SURFTEST 212 surface roughness tester. After the substrate surface had been roughened, the substrate was heat treated at approximately 450° C. in an oxygen containing environment for approximately two hours in order to form an oxide layer over the substrate surface.

The prepared substrate was next painted with a n-butanol solution containing salts of iridium and tantalum. The ratio of iridium to tantalum in the solution was approximately 65% to 35% by weight. The solution was allowed to dry at ambient temperature for approximately 20 minutes. The painted titanium substrate was subsequently heat treated in a furnace having an oxygen containing atmosphere at approximately 500° C. for approximately 20–30 minutes to form an iridium oxide/tantalum oxide composite coating. The process of painting and heat treating the titanium substrate was repeated in order to obtain a first layer having a total loading of approximately 2.0 g/m$^2$. When the desired loading was achieved, the coated substrate was heat treated for approximately one hour at approximately 500° C.

A second layer of platinum was formed over the first layer by electrodeposition from a solution containing platinum salt. The thickness of the platinum second layer was in one example (i.e., Example 3A) 10 $\mu$inches. In a second example (i.e., Example 3B) the thickness of the platinum second layer was 20 $\mu$inches.

Following the electrodeposition process, the anode was again painted with an n-butanol solution containing salts of iridium and tantalum. The ratio of iridium to tantalum in the solution being approximately 65% to 35% by weight. The solution was allowed to dry at ambient temperature for approximately 20 minutes, and the anode was subsequently heat treated in a furnace having an oxygen containing atmosphere at approximately 500° C. for approximately 20–30 minutes to form an iridium oxide/tantalum oxide composite coating. The process of painting and heat treating was repeated to obtain a third layer having a total loading of about 10 g/m$^2$.

COMPARATIVE EXAMPLES

EXAMPLES 4A–4B

Single-Layer Anode

A titanium substrate was cleaned with an alkaline cleansing bath and then grit blasted with grit 60 aluminum oxide such that the roughness of the blasted area was between 4 $\mu$m to 6 $\mu$m as measured by a SURFTEST 212 roughness tester. The titanium substrate was coated with a n-butanol solution contain salts or iridium and tantalum with the ratio of iridium to tantalum in the solution being approximately 65% to 35% by weight. The solution was allowed to dry at ambient temperature for approximately 20 minutes. The coated titanium substrate was subsequently heat treated in a furnace having an oxygen containing atmosphere at approximately 500° C. for approximately 20–30 minutes to form an iridium oxide/tantalum oxide composite coating. The process of coating and heat treating the titanium substrate is repeated as necessary in order to obtain a total loading of in one example (i.e., Example 4A) of 12 g/m$^2$. In a second example (i.e., Example 4B), the total loading of the first layer was 30 g/m$^2$. After the required loading was achieved, the coated substrate was heat treated for approximately one hour at approximately 500° C.

EXAMPLE 5

Single-Layer Anode

A titanium substrate was cleaned with an alkaline cleansing bath and then grit blasted using grit 30 aluminum oxide, with the resulting surface roughness of the titanium substrate having an Rq range of 6 $\mu$m to 8 $\mu$m as measured by a SURFTEST 212 roughness tester. The titanium substrate was coated with a n-butanol solution containing salts or iridium and tantalum with the ratio of iridium to tantalum in the solution being approximately 65% to 35% by weight. The solution was allowed to dry at ambient temperature for approximately 20 minutes. The coated titanium substrate was subsequently heat treated in a furnace having an oxygen containing atmosphere at approximately 500° C. for approximately 20–30 minutes to form an iridium oxide/tantalum oxide composite coating. The process of coating and heat treating the titanium substrate was repeated as necessary in order to obtain a total loading of 12 g/m$^2$. After the required loading was achieved, the coated substrate is heat treated for approximately one hour at approximately 500° C.

EXAMPLE 6

Two-Layer Anode

A titanium substrate was cleaned with an alkaline cleansing bath and then grit blasted with grit 60 aluminum oxide such that the resulting surface roughness was is an Rq range of 4 μm to 6 μm as measured by a SURFTEST 212 roughness tester. The roughened titanium substrate was coated with platinum having a thickness of 10 μinches (0.25 μm) by electrodeposition from a solution containing platinum salt. The platinum coated substrate was subsequently coated with an n-butanol solution containing salts or iridium and tantalum with the ratio of iridium to tantalum in the solution being approximately 65% to 35% by weight. The solution was allowed to dry at ambient temperature for approximately 20 minutes. The coated titanium substrate was subsequently heat treated in a furnace having an oxygen containing atmosphere at approximately 500° C. for approximately 20–30 minutes to form an iridium oxide/tantalum oxide composite coating. The process of coating and heat treating the titanium substrate was repeated as necessary in order to obtain a total loading of 12 g/m$^2$. After the desired loading was achieved, the coated substrate was heat treated for approximately one hour at approximately 500° C.

EXAMPLE 7

Two-Layer Anode

A titanium substrate was cleaned with an alkaline cleansing bath and then grit blasted using grit 60 aluminum oxide such that the resulting surface roughness had an Rq range of 4 μm to 6 μm as measured by a SURFTEST 212 roughness tester. The roughened titanium substrate was coated with an n-butanol solution containing salts or iridium and tantalum with the ratio of iridium to tantalum in the solution being approximately 65% to 35% by weight. The solution was allowed to dry at ambient temperature for approximately 20 minutes. The coated titanium substrate was subsequently heat treated in a furnace having an oxygen containing atmosphere at approximately 500° C. for approximately 20–30 minutes to form an iridium oxide/tantalum oxide composite coating. The process of coating and heat treating the titanium substrate was repeated as necessary in order to obtain a total loading of 12 g/m$^2$. After the desired loading was achieved, the coated substrate was heat treated for approximately one hour at approximately 500° C. The anode was then coated with platinum having a thickness of 10 μinches (0.25 μm) by electrodeposition from a solution containing platinum salt.

Testing of Anodes Prepared in Accordance With Examples 1–7

The anodes manufactured in accordance with the examples set forth above were tested under the accelerated aging test conditions summarized in Table 1 to determine their respective service lives or time to failure as measured in kAh/m$^2$.

TABLE 1

Summary of Accelerated Aging Test

| Parameter | Condition |
|---|---|
| Electrolyte Composition | 9.0 ± 0.1 Weight Percent Sulfuric Acid |
| Temperature | 70 ± 2° C. |
| Anode Current Density | 13,000 ± 250 A/m$^2$ |
| Anode Dimensions | 2.22 cm Diameter |
| Cathode Dimensions | 3.8 cm × 3.8 cm |
| Cell volume | 250 ± 10 cm$^3$ |
| Cell Flow | 10–20 liters/hour |

The test results of various examples of anodes manufactured in accordance with the present invention are summarized in Table 2.

TABLE 2

| Example | Life Time (kAh/m$^2$) |
|---|---|
| 1A | 35,000–49,000[1] |
| 1B | 35,000–58,000[1] |
| 2A | 15,000 and 16,000[2] |
| 2B | 15,000 and 22,500[2] |
| 2C | 28,000 and 33,000[2] |
| 3A | 55,000 and 88,000[2] |
| 3B | 88,000[2] |

([1]Four anodes tested; [2]Two anodes tested.)

The results of the accelerated aging tests of the anodes manufactured in accordance with the comparative examples are summarized in Table 3 below.

TABLE 3

| Example | Life Time (kAb/m$^2$) |
|---|---|
| 4A | 3,500–6,900[1] |
| 4B | 5,200 and 6,200[2] |
| 5 | 6,900 and 7,800[2] |
| 6 | 20,400 and 28,100[2] |
| 7 | 12,000[2] |

([1]Six anodes tested; [2]Two anodes tested.)

As will be appreciated by review of the test results, all the anodes formulated in accordance with the present invention exhibited equal or superior service life than the anodes prepared in accordance with the comparative examples. It is especially noteworthy that the test results indicate that the preferred embodiment (i.e., Example 3) exhibited an accelerated aging service life of approximately twice that of any anode prepared in accordance with the comparative examples.

All publications mentioned herein above are hereby incorporated in their entirety. While the foregoing invention has been described in detail for the purposed of clarity and understanding, it will be appreciated by one skilled in the art from a reading of the disclosure that various changes in form and detail can be made without departing from the true scope of the invention in the appended claims.

What is claimed is:

1. An anode comprising:

(a) a valve metal substrate;

(b) a first layer comprising at least one platinum-group metal or platinum-group metal oxide and at least one valve metal or valve metal oxide formed on said valve metal substrate;

(c) a second layer comprising a platinum-group metal formed on said first layer; and (d) a third layer comprising at least one platinum-group metal or platinum-group metal oxide and at least one valve metal or valve metal oxide formed on said second layer.

2. The anode of claim 1, wherein said valve metal substrate comprises titanium, niobium, tantalum, or zirconium.

3. The anode of claim 1, wherein said valve metal substrate comprises titanium.

4. The anode of claim 1, wherein said platinum-group metal or platinum-group metal oxide of said first layer is selected group consisting of ruthenium, osmium, rhodium, iridium, palladium, platinum, ruthenium oxide, osmium oxide, rhodium oxide, iridium oxide, palladium oxide, and platinum oxide.

5. The anode of claim 1, wherein said platinum-group metal or platinum-group metal oxide of said first layer is iridium oxide.

6. The anode of claim 1, wherein said valve metal or valve metal oxide of said first layer is selected from the group consisting of tantalum, tantalum oxide, titanium, titanium oxide, zirconium, and zirconium oxide.

7. The anode of claim 1, wherein said valve metal or valve metal oxide of said first layer is tantalum oxide.

8. The anode of claim 1, wherein said platinum-group metal or platinum-group metal oxide of said first layer is iridium oxide and said valve metal or valve metal oxide of said first layer is tantalum oxide.

9. The anode of claim 1, wherein said platinum-group metal of said second layer is selected group consisting of ruthenium, osmium, rhodium, iridium, palladium, and platinum.

10. The anode of claim 1, wherein said platinum-group metal of said second layer is platinum.

11. The anode of claim 1, wherein said platinum-group metal or platinum-group metal oxide of said third layer is selected group consisting of ruthenium, osmium, rhodium, iridium, palladium, platinum, ruthenium oxide, osmium oxide, rhodium oxide, iridium oxide, palladium oxide, and platinum oxide.

12. The anode of claim 1, wherein said platinum-group metal or platinum-group metal oxide of said third layer is iridium oxide.

13. The anode of claim 1, wherein said valve metal or valve metal oxide of said third layer is selected from the group consisting of tantalum, tantalum oxide, titanium, titanium oxide, zirconium, and zirconium oxide.

14. The anode of claim 1, wherein said valve metal or valve metal oxide of said third layer is tantalum oxide.

15. The anode of claim 1, wherein said platinum-group metal or platinum-group metal oxide of said third layer is iridium oxide and said valve metal or valve metal oxide of said third layer is tantalum oxide.

16. The anode of claim 1, wherein said valve metal substrate comprises titanium, said first layer comprises iridium oxide and tantalum oxide, said second layer comprises platinum, and said third layer comprises iridium oxide and tantalum oxide.

17. The anode of claim 16, wherein the total loading of said first layer formed on said value metal substrate is 0.5–2.5 $g/m^2$, the thickness of said second layer is 0.1–3.0 $\mu$m, and the total loading of said third layer formed on said second layer is 5–100 $g/m^2$.

18. The anode of claim 16, wherein the total loading of said first layer formed on said value metal substrate is 1.8–2.2 $g/m^2$, the thickness of said second layer is 0.25–1.0 $\mu$m, and the total loading of said third layer is 10–40 $g/m^2$.

19. The anode of claim 1, wherein the surface of said valve metal substrate has a roughness Rq of 2–12 $\mu$m.

20. The anode of claim 1, wherein the surface of said valve metal substrate has a roughness Rq of 3–6 $\mu$m.

21. The anode of claim 1, wherein the total loading of said first layer formed on said valve metal substrate is 0.5–2.5 $g/m^2$.

22. The anode of claim 1, wherein the total loading of said first layer formed on said valve metal substrate is 1.8–2.2 $g/m^2$.

23. The anode of claim 1, wherein the thickness of said second layer is 0.1–3.0 $\mu$m.

24. The anode of claim 1, wherein the thickness of said second layer is 0.25–1.0 $\mu$m.

25. The anode of claim 1, wherein the total loading of said third layer formed on said second layer is 5–100 $g/m^2$.

26. The anode of claim 1, wherein the total loading of said third layer formed on said second layer is 10–40 $g/m^2$.

* * * * *